United States Patent [19]

Creel

[11] 4,119,321

[45] Oct. 10, 1978

[54] GAME WITH BOARD AND PIECES AND DICE

[76] Inventor: Jack R. Creel, P.O. Box 2176, Pensacola, Fla. 32503

[21] Appl. No.: 804,121

[22] Filed: Jun. 6, 1977

[51] Int. Cl.[2] ..... A63F 3/00

[52] U.S. Cl. ..... 273/248

[58] Field of Search ..... 273/134 D, 134 DB, 134 GP, 273/134 BD, 134 AD, 134 CH, 134 AG, 248, 249

[56] References Cited

U.S. PATENT DOCUMENTS

| | | | |
|---|---|---|---|
| 2,658,760 | 11/1953 | Brost | 273/134 CH |
| 2,794,642 | 6/1957 | O'Neill | 273/134 AD |
| 3,883,143 | 5/1975 | Kelley et al. | 273/134 D |
| 4,042,245 | 8/1977 | Zarour | 273/134 CH |

FOREIGN PATENT DOCUMENTS

| | | | |
|---|---|---|---|
| 2,304,374 | 10/1976 | France | 273/134 D |
| 196,439 | 4/1923 | United Kingdom | 273/134 AD |

*Primary Examiner*—Richard C. Pinkham
*Assistant Examiner*—Harry G. Strappello
*Attorney, Agent, or Firm*—Dowell & Dowell

[57] ABSTRACT

A game including a game board with plural playing tracks each having multiple contiguous rows of spaces to which multiple game pieces can be moved by each of several players in response to the rolling of dice, the pieces bearing number indicia and being movable toward and ultimately into scoring positions whereat their numbers are added together until one player achieves a winning predetermined aggregate score.

5 Claims, 3 Drawing Figures

FIG. 1.
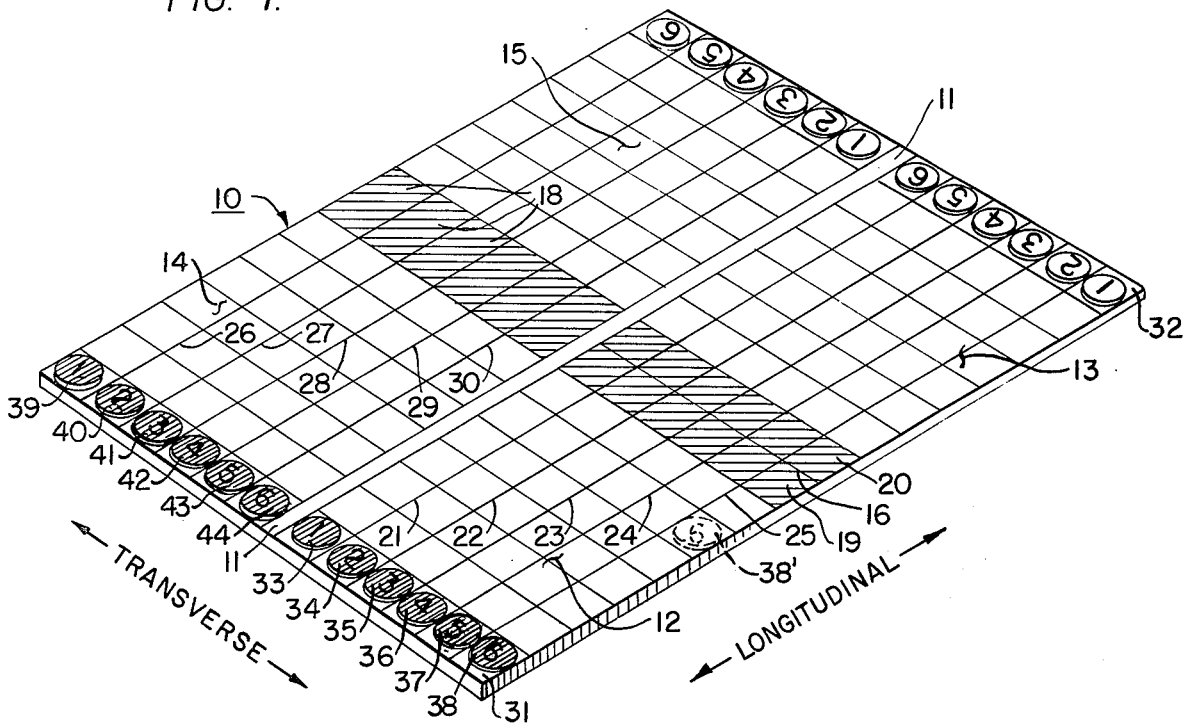
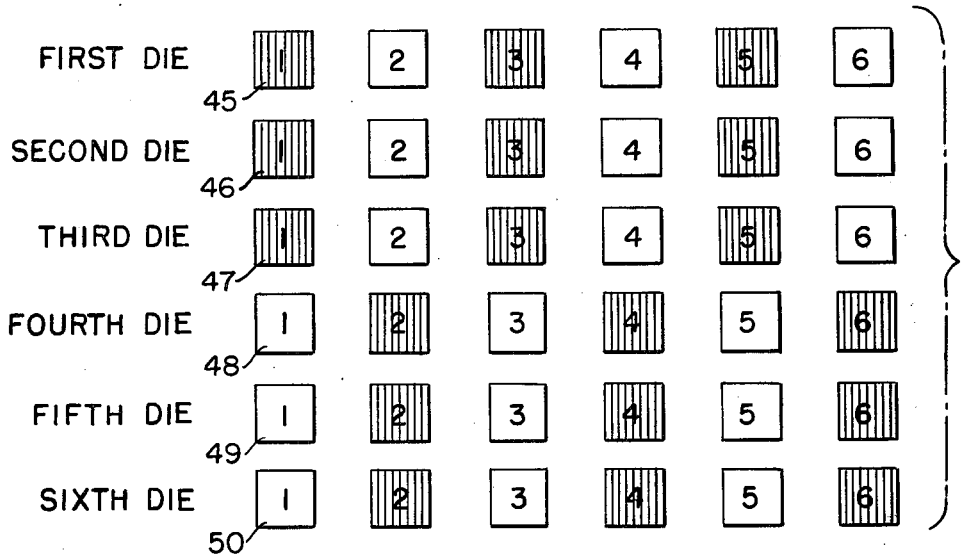
FIG. 2.
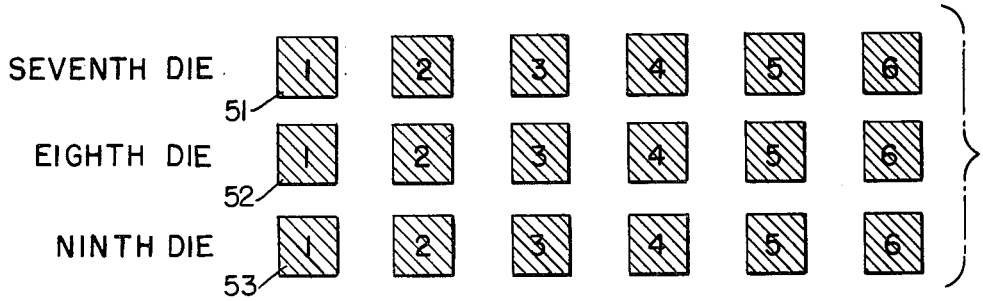
FIG. 3.

GAME WITH BOARD AND PIECES AND DICE

FIELD OF INVENTION

This invention relates to game apparatus, and more particularly relates to the combination of a special game board, and multiple game pieces, and dice by which during each turn the players choose one of several possible pieces that can be moved and then select one of several distances through which the chosen piece can be moved.

BACKGROUND AND PRIOR ART

There are a large number of games which are played on special purpose game boards using one or more game pieces for each player, wherein the distances along the board through which the game pieces are moved are selected by the rolling of dice according to a fixed set of rules. Many of these games suffer from the drawback that the players soon become bored with the game because they are not called upon to exercise judgement in advancing the game. Instead they merely advance the game mechanically according to whatever number turns up on the faces of the dice when they are rolled during the turn of the player.

The prior art shows many games of the aforesaid general type. For instance, U.S. Pat. No. 3,826,498 to Monek shows a golf game which uses multiple dice which are variously colored and which have various indicia thereon to specify the moves made by each player when the dice are rolled, the progress of the player being advanced thereby along a rectangular board.

U.S. Pat. No. 2,658,760 to Brost and U.S. Pat. No. 3,963,243 to Contento show games by which game pieces are advanced along closed paths according to various chance designations made by dice or other means for indicating the distances through which the pieces can be moved, etc. Three other games of this general type are shown in Michener Pat. No. 2,044,122, Imperato Pat. No. 3,560,127 and Weinstein Pat. No. et al 3,463,496.

THE INVENTION

The present invention provides a game board, game pieces, and various dice by which there are designated for advancement in response to each rolling of the dice a number of different possible game pieces from which the player can choose one to the exclusion of the other pieces, and the same roll of the dice also designating a number of different distances through which the chosen game piece may be moved and one of which distances must be chosen. It is a characteristic of this game that the player is required to exercise personal judgement in choosing which of several selectible pieces can be moved and in further selecting which of several distances the piece can be moved through.

The object of the game is to move a number of the game pieces, each player having a multiplicity thereof, toward final scoring positions in which the numeric indicia on all the game pieces which have reached the scoring position are added together to achieve a predetermined scoring number, which in the particular illustration described below is the number "21". The player must move his pieces in such a way as to have them add up precisely to "21" in the scoring position without exceeding that number, and the first party arriving at the predetermined scoring number is the winner. As in the card game known as "21" the manner in which the aggregate number 21 is approached becomes increasingly important the nearer the player's score approaches 21, since it is increasingly easy to exceed that number. Herein, lies the skill of the game exercised by the player.

The players are uniquely assigned game tracks, each one of which is divided into a number of contiguous rows of spaces. Each player has a number of game pieces bearing different identifying numerals and initially placed in starting position spaces at the beginning of his various rows. The colors of the playing pieces are matched with colors on some of the faces of the dice whereby the player is entitled to use only the numerals appearing on those faces of the dice which have the same color as his playing pieces. After each roll of the dice, the player is entitled to use these numerals by either adding together or subtracting the numerals appearing on the appropriately colored faces of two of the dice, thereby to select certain game pieces which can be moved from which the player must choose one. Similarly, by adding or subtracting numerals appearing on other differently colored dice the player chooses from these several different numbers a particular number of spaces through which the chosen game piece can be moved. The challenge to the player's skill and judgement resides in these selections.

It is an object of this invention to provide game apparatus and a game in which the judgement of the player is of prime importance in determining whether he wins or loses the game and in which this judgement is only somewhat limited by colors and numerals appearing on the faces of the various playing dice.

It is another object of this invention to provide a gaming apparatus in which, in addition to the main playing track, there is a second or auxiliary playing track assigned to each player, the auxiliary playing track having multiple contiguous rows of spaces and multiple game pieces, the throw of the dice and the rules of the game selecting which of the two playing tracks the player can move in at a particular time.

Another object of the invention is to provide a game in which the numerals on the faces of the game pieces in each playing track add up precisely to the number which is predetermined as the winning score, whereby the numbers on the auxiliary playing track become more significant since the achieving of a good score in the scoring position spaces on one or two of the auxiliary playing track rows serves as a bonus, making it not only easier to achieve the predetermined number, but making this achievement occur at an earlier time and with fewer rolls of the dice, so that a particular player need not get all of his game pieces into scoring position spaces on a game track in order to achieve the winning score.

Other objects and advantages of the invention will become apparent during the following discussion of the drawing:

THE DRAWING

FIG. 1 is a perspective view of a game board according to the present invention and showing four sets of game pieces in start position spaces on the board;

FIG. 2 is a developed view of the six different faces of six different "playing" dice which are used in the playing of the game; and FIG. 3 is a developed view of the six different faces of three distinctively colored "moving" dice used in the playing of the game.

Referring to the drawings, the game board 10 shown in the illustrative embodiment of FIG. 1 is divided longitudinally down the middle by a dividing strip 11 whereby the board is divided into a pair of opposed main playing tracks 12 and 13 appearing on one side of the dividing strip 11, and into another pair of auxiliary playing tracks 14 and 15 located on the other side of the dividing strip 11. The main playing tracks 12 and 13 abut each other in the longitudinal center of the board at the line 16, whereas the auxiliary playing tracks 14 and 15 are joined near the longitudinal center of the board by a series of scoring position spaces generally referred to by the reference character 18. On opposite sides of the abutting line 16 of the main playing tracks there are two scoring position areas designated 19 and 20, each comprising a plurality of scoring position spaces.

Each of the playing tracks, including the main playing tracks 12 and 13 and the auxiliary playing tracks 14 and 15, have a plurality of contiguous longitudinal rows separated by the lines 21, 22, 23, 24 and 25 in the main playing tracks 12 and 13. In the auxiliary playing tracks 14 and 15 the contiguous longitudinal rows are separated by the lines 26, 27, 28, 29 and 30.

At the outer end of each of the contiguous rows in each of the playing tracks there is a starting position for a game piece, the game pieces all resembling flat discs with numeric indicia thereon, in the illustrated example ranging from the numbers 1 through 6 inclusive. These indicia correspond with the row in which the game piece is placed, numbering the rows from left to right consecutively at each end of the game board where the players will sit facing each other. Thus, in the main playing track 12, the starting position spaces extend transversely across the board in alignment with the space bearing the reference numeral 31, these spaces in the drawing being shown occupied by two sets of game pieces respectively labelled 1 through 6 inclusive.

Likewise, at the other end of the gaming board the starting position spaces are transversely aligned with the space marked with the reference character 32, and all these spaces are likewise occupied with game pieces. The game pieces in the set shown on the starting position spaces of the main playing track 12 are designated 33, 34, 35, 36, 37 and 38. In the auxiliary playing track 14, the game pieces are albelled 39, 40, 41, 42, 43 and 44. The game pices at the far end of the board and occupying the playing tracks 13 and 15 are similar to the game pieces 33 through 44 inclusive except that the latter game pieces are colored red, whereas, the game pieces on the playing tracks 13 and 15 are white, these two colors having been arbitrarily selected merely for illustrative purposes. Likewise, the scoring position spaces which are generally labelled 18, 19 and 20 are colored with another distinctive color, for instance brown.

FIG. 2 shows "playing" dice numbered 1 through 6. The dice designated first, second and third have their odd numbered faces colored red and their even numbered faces colored white to correspond respectively with the colors of the playing pieces used by the two different players. Conversely, the fourth, fifth and sixth dice have their odd numbered faces colored white and their even numbered faces colored red. As a result, the distribution of colors and numbers on the faces of the first through the sixth dice are equitably distributed with regard to both players. The first through the sixth dice are labelled respectively 45, 46, 47, 48, 49 and 50.

There are three other dice shown in FIG. 3 of the drawing, and these are the "moving" dice. They have all of their faces colored with the same color, in this instance, green being shown as the color selected since it has not been used on any other parts of the game apparatus. The seventh, eighth and ninth dice are respectively labelled 51, 52 and 53, and their faces also bear the numeral indicia 1 through 6 inclusive.

The red and white "playing" dice shown in FIG. 2 are used to determine which of the various game pieces can be moved by a player who has just shaken all of the dice simultaneously and rolled them out in preparation for making his move. The green "moving" dice shown in FIG. 3 are used to determine how many spaces the same player can move whichever one of the game pieces he chooses in response to the various selections made possible by his throw of the first through the sixth dice. The manner in which the game is played will be set forth hereinafter.

MANNER OF PLAYING THE GAME

It is the object of the game to have one or the other player win by moving enough of his game pieces from their starting positions as shown in FIG. 1 into various scoring position spaces 18, 19 and 20 so that the aggregate sum of the numbers appearing as indicia on the game pieces which have been moved into the scoring positions 18, 19 and 20 will exactly equal the preselected winning number, in the present example, the winning number being "21". As the game proceeds, the players take turns during which each player moves one game piece in the main playing track 12 or 13 according to the rules of the game and the roll of the dice. When moving in the main tracks 12 and 13 some of the game pieces eventually reach the scoring position spaces 19 and 20. Under other circumstances the players are able to move some of the game pieces in the auxiliary tracks 14 and 15 into the scoring position spaces 18. However, unlike the dual scoring position spaces 19 and 20 of the main tracks, the scoring position spaces 18 can only be occupied exclusively by one player. Therefore, the player in auxiliary track 14 cannot occupy a scoring position space 18 which has previously been occupied by the player in auxiliary track 15, and vice versa. This is contrary to the situation with regard to main playing tracks 12 and 13 in which the two players have their own uniquely occupiable scoring spaces 19 and 20.

At the beginning of the game, the players shake the dice and roll them, and count the total number of points turning up on the first through the sixth dice in the color which he has been assigned. The person having the higher number of points in his own color is the winner of the first move.

The first player then rolls all nine dice at the same time, and from this roll he selects which game piece to move and how far to move it. First, he looks at the first through the sixth dice and notes the numbers which are turned up on the faces whose color matches the color of his game piece. If the player turns up only one face of his own color, or none, he cannot move and the next player is allowed to proceed. On the other hand, if he turns up two or more dice of his assigned color, then he is permitted either to add together, or to substract one from the other, any two numbers appearing on the faces of the dice. For example, if three dice among the red and white playing dice have red faces turned upwardly and bearing the numerals 2, 5, and 1, he can then move any one of four pieces in the group 33 through 38 on the main playing track as follows: He can move the number 4 game piece 36 as a result of subtracting from the 5 on one face the numeral 1 on another face to produce a 4. Alternatively, he can move the number 6 game piece 38 by adding together the 5 on one face with the 1 on another face to produce the numeral 6. Still further, he can choose to move the number 3 game piece 35 as a result of subtracting from the 5 on one face the 2 on another face. Or finally, he can move the number 1 game piece 33 by subtracting from the 2 on one face the 1 on another face. Thus, he can select any one of the game pieces 1, 3, 6 or 4 which he wishes. At the beginning of the game, it is wise to select a high number, and therefore, he would be inclined to select the game piece showing the numeral 6 on its face and labelled number 38 in FIG. 1.

The green dice labelled seventh, eighth and ninth in FIG. 3 tells him how many spaces he can elect to move the chosen game piece 38. Assuming as an example that the green dice show the numbers 1, 3 and 6, he is again permitted to make any combination by adding or subtracting any two of these three numerals. Thus, he can choose to move four spaces by adding the green 3 to the green 1; he can choose to move two spaces by subtracting from the green 3 the green 1; he can move five spaces as a result of subtracting from the green 6 the green 1; or he can move three spaces by subtracting from the green 6 the green 3 on the face of the dice. Probably he would elect to move five spaces in order to approach the scoring position space 19 as rapidly as possible. This would permit him to move the game piece 38 to the position shown in dotted lines and labelled 38' in FIG. 1.

The "red" player then relinquishes the dice to the "white" player and he performs a similar function by rolling all 9 of the dice and using the "playing" dice labelled 45 and 50 inclusive to determine which game pieces he would be permitted to choose from, then using the green "moving" dice labelled 51 through 53 by adding or subtracting their values to determine a group of distances from which he may choose one distance for moving his game piece. A player has only one throw at a time unless he throws three of a kind on the moving green dice 51 through 53, in which case he then is given an extra turn to be taken in immediate succession. If toward the end of a game a player throws the dice and finds that there is no combination achievable by adding and subtracting their face values which he can actually move because of the position of his pieces on the board, then he must hand over the dice and fail to move during that turn. At any point in the game, a player need not move if he so chooses, but in so doing he loses his turn.

The auxiliary playing tracks 14 and 15 can be used only by a player when he throws a double in his own color, either red or white depending on which player is making the move. He may then proceed in the auxiliary track in the manner set forth above with respect to the main playing tracks, but this time he will move one of the game pieces, i.e. 39 through 44, in an auxiliary track 14 or 15.

Since it is possible for a player to throw one, two or three doubles of his own color in any one throw of the dice, it is therefore possible that he can move a corresponding number of game pieces in a single throw of the dice, the pieces being selected for movement through a number of spaces which are also selected by adding or subtracting numbers on the appropriately colored dice.

As mentioned above, the auxiliary playing tracks have only one scoring space in each row for both players. The space is therefore shared, but it cannot be occupied by two players simultaneously. Therefore, no player can move a piece into the scoring section space 18 if his opponent already has his piece in that same scoring position. The only exception occurs in the case where a player throws three of a kind in his color on the playing dice and is in a position where he can make a move selectible from the dice and have that move place him in a scoring space designated by reference character 18 but already occupied by his opponent. In that event, he can move his piece to score in that same scoring position space 18, and cause his opponent to move his piece, which also occupied that same scoring space, all the way back to the starting position.

It is to be noted that the present invention is not to be limited to a board for two players, but that a larger board for more than two players can be provided.

This invention is not to be limited to the illustrative embodiment shown in the drawings, for obviously changes may be made therein within the scope of the following claims:

I claim:

1. A game of the type including game pieces movable upon a game board by plural players in response to the rolling of dice from starting positions of the pieces to scoring positions thereof to achieve a predetermined winning number of scoring points by adding together the values of the numbers carried by multiple game pieces moved into scoring positions, comprising:

(a) a game board having plural playing tracks each having a multiplicity of contiguous rows of spaces each extending from a starting position space to a scoring position space, and the playing tracks being assigned to the players;

(b) plural sets of differently colored game pieces, each player being assigned pieces of one distinguishing color, the game pieces being initially arranged with one piece in the starting position space of each of the contiguous rows of the playing track assigned to that player, and the game pieces of each set bearing indicia each comprising a different number;

(c) a set of multiple playing dice for selecting which of a player's pieces can be moved and each having faces bearing numbers corresponding with said indicia and having the various faces distinguishingly colored to match the colors of the sets of game pieces, the faces of the dice in the set having the same distribution of colors and numbers for the various game pieces;

(d) a group of uniquely colored moving dice rollable with said set of dice and having faces bearing numerals for selecting how many spaces a selected game pieces can be moved; and (e) each player being assigned on said game board two playing tracks respectively having a multiplicity of contiguous rows of spaces each extending from a starting position space to a scoring position space, and each player being assigned two sets of game pieces which bear number indicia and are similarly colored for each player and occupying said two playing tracks, one of the playing tracks having scoring position spaces unique to that player, and the other playing track having only one scoring position space for each row which is accessible to both players but can only be occupied by the game piece of one player at a time.

2. A game as set forth in claim 1, wherein the predetermined winning score number is 21, and the dice each have six faces, and these faces and the indicia on the game pieces in each set are numbered consecutively 1 through 6, adding up to 21.

3. A game as set forth in claim 1, wherein there are two players and the two playing tracks of each player on said game board are arranged side by side, and the playing tracks of different players are arranged mutually parallel and aligned with their scoring position spaces abutting.

4. A game as set forth in claim 1, wherein each playing track has the same number of rows of spaces as there are faces on each playing die.

5. A game as set forth in claim 1, wherein said playing track row has the same total number of spaces as there are faces on each moving die.

* * * * *